US005906163A

United States Patent [19]

Gagne et al.

[11] Patent Number: 5,906,163

[45] Date of Patent: May 25, 1999

[54] APPARATUS AND METHOD FOR PREVENTING CONDENSATION IN MACHINES PROCESSING A WEB OF MATERIAL

[75] Inventors: Daniel Paul Gagne, S. Berwick, Me.; Charles Douglas Lyman, Pelham, N.H.

[73] Assignee: Heidelberg Druckmaschinen AG, Heidelberg, Germany

[21] Appl. No.: 08/993,326

[22] Filed: Dec. 18, 1997

[51] Int. Cl.[6] ..... B41F 1/34

[52] U.S. Cl. ..... 101/480; 101/417

[58] Field of Search ..... 101/417, 416.1, 101/480, 219, 227; 34/365, 640

[56] References Cited

U.S. PATENT DOCUMENTS 5,347,726 9/1994 Quadracci et al. ..... 34/465

*Primary Examiner*—Edgar Burr
*Assistant Examiner*—Charles H. Nolan, Jr.
*Attorney, Agent, or Firm*—Kenyon & Kenyon

[57] ABSTRACT

An apparatus and method for preventing condensation in machines for processing web-like material includes locating a condensation prevention device to reduce the amount of moisture near selected components to be protected and/or maintaining the surface temperature of components of a processing unit above the dew point of the surrounding air.

19 Claims, 2 Drawing Sheets

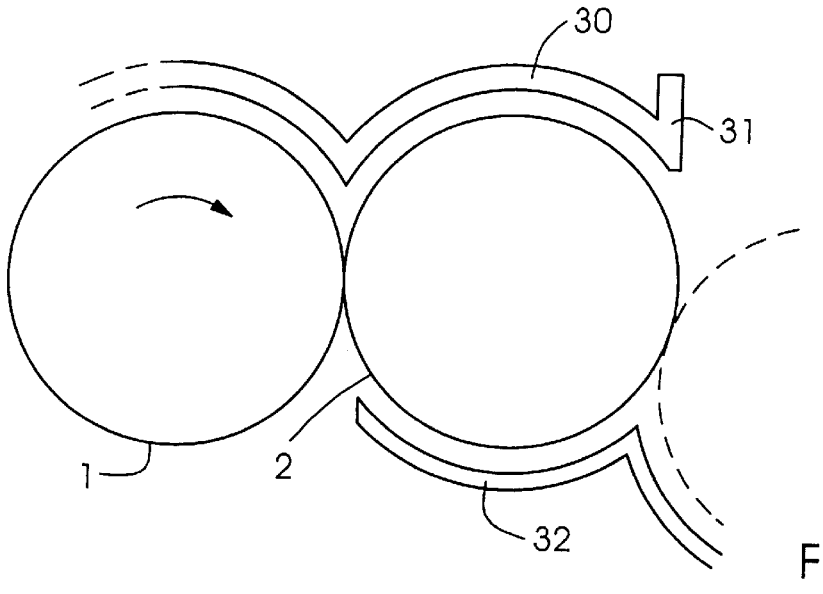
Fig.2
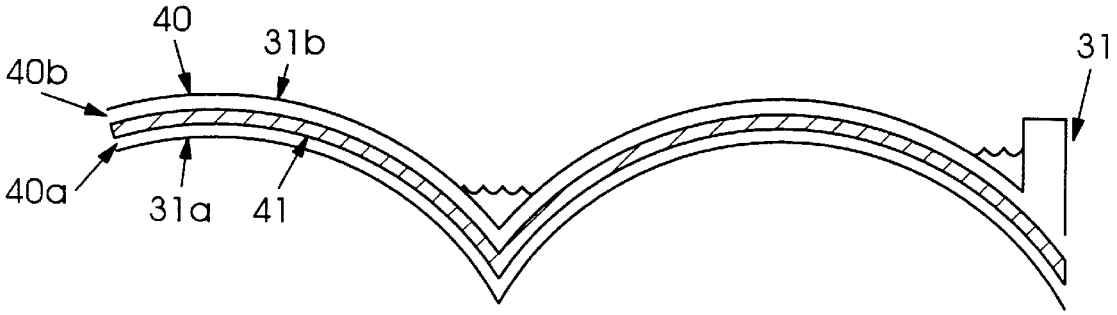
Fig.3
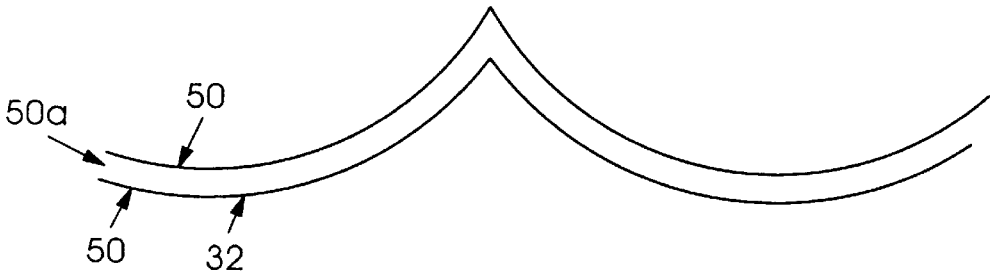

APPARATUS AND METHOD FOR PREVENTING CONDENSATION IN MACHINES PROCESSING A WEB OF MATERIAL

BACKGROUND INFORMATION

1. Field of the Invention

The present invention relates to an apparatus for preventing condensation in machines processing web-like material. More particularly, the present invention relates to an apparatus and method for preventing condensation in a printing press.

2. Description of the Related Art

In print shops and press testing facilities there has been a problem that on high-speed machines, condensation occurs on those safety elements, such as finger guards, vital to protecting the press operating staff as well as on other sub-systems of the printing press. Condensation on a guard can be, for example, in the form of droplets on the surfaces which can collect to form drops dripping either onto the surface of the web-type material to be printed upon or into the printing unit itself, thereby causing print defects and other undesirable conditions. Condensation below the web-type material can cause print defects as well, for example, when droplets drip onto surfaces of vibrator rollers or the like of a lower printing unit.

Even on other printing unit components such as shields, rails, frame parts or tail tuckers, condensation may also occur in the form of droplets dripping on the web or on components of the ink train, thus posing a risk for maintaining print quality. For example, condensation of water on the surface of print unit rolls, especially the rolls in the dampening system of a printing press, can have a detrimental effect on the water feed in the lithographic printing process—condensed water added to the dampening solution on a roll can exceed the capacity of the nip resulting in excess water build-up and excess water in the nip can result in unstable water feed, thereby reducing print quality. Indeed, drips onto the web can cause direct lithographic errors and condensation on a roll, especially dampener rolls, can destabilize the lithographic process.

It is an object of the present invention to prevent defects on printed material from a printing press due to condensation. It is another object of the present invention to maintain those surfaces of components where condensation is likely to occur at a temperature level above the dew point and to create a surface where condensation can collect without affecting the print quality of a printing unit.

SUMMARY OF THE INVENTION

According to an embodiment of the present invention, an apparatus for preventing condensation in machines for processing web-like material includes components arranged in a processing unit wherein the components are designed and located to reduce the amount of moisture near selected components of the printing press and may include a mechanism to alter temperature differences between the surfaces of selected components and the surrounding air. For example, the hollow interior of a nip guard may be charged with mediums of different temperatures, such as water, oil, air or a mixture thereof having suitable heat transfer properties, to create a cool surface and a warm surface to reduce condensation in selected areas of, for example, a printing press. The mediums could also include any pure fluid with appropriate heat transfer properties, and in particular a glycol or other antifreeze-type compound, which compounds are frequently mixed with water in printing presses to reduce corrosion.

A closed loop can also be established among components for which the surface temperature has to be kept above the dew point of the surrounding air or for which cool and warm surfaces are to be established. The closed loop may include, for example, a pipe system with supply and recirculating portions and a reservoir. The reservoir may include a heat exchange element and a pumping and stirring devices maintaining a uniform temperature distribution within each medium contained in the reservoir. Through a manually-operable or remote-controllable flow rate control mechanism, such as actuating valves, the temperature levels of the mediums in the components, for example, nip guards, cross bars, pans, shields or vibrator rollers, can be adjusted accordingly.

In addition to using, for example, the hollow interior of a nip guard, another embodiment of the present invention includes a condensation prevention guard placed near the surface of print or blanket cylinders of a printing press or near a roll, for example a roll of a dampener unit, that conforms to a surface portion of the roll to reduce the volume of moist air from which water can condense onto the cylinders or roll. While the condensation prevention guard can be passive, in another embodiment of the present invention a side of the guard facing the cylinders or roll can be heated above the ambient air temperature to further prevent condensation forming on the guard. In yet another embodiment of the present invention, cooling the side of the condensation prevention guard facing away from cylinders or roll to below the ambient air temperature will provide a surface for condensation, further reducing the water available in the atmosphere in the region of the roll. The condensation prevention guard can also be designed to collect condensation on, for example, the cool side of the guard.

BRIEF DESCRIPTION OF THE DRAWINGS

The foregoing and other features of the present invention will become apparent to those skilled in the art upon reading the following description of preferred embodiments of the invention in view of the accompany drawings, wherein:

FIG. 2 is an exemplary embodiment of a condensation prevention guard according to the present invention; and FIG. 3 is a cross-sectional view of another exemplary embodiment of a condensation prevention guard according to the present invention.

DETAILED DESCRIPTION OF THE INVENTION

Figure 1:
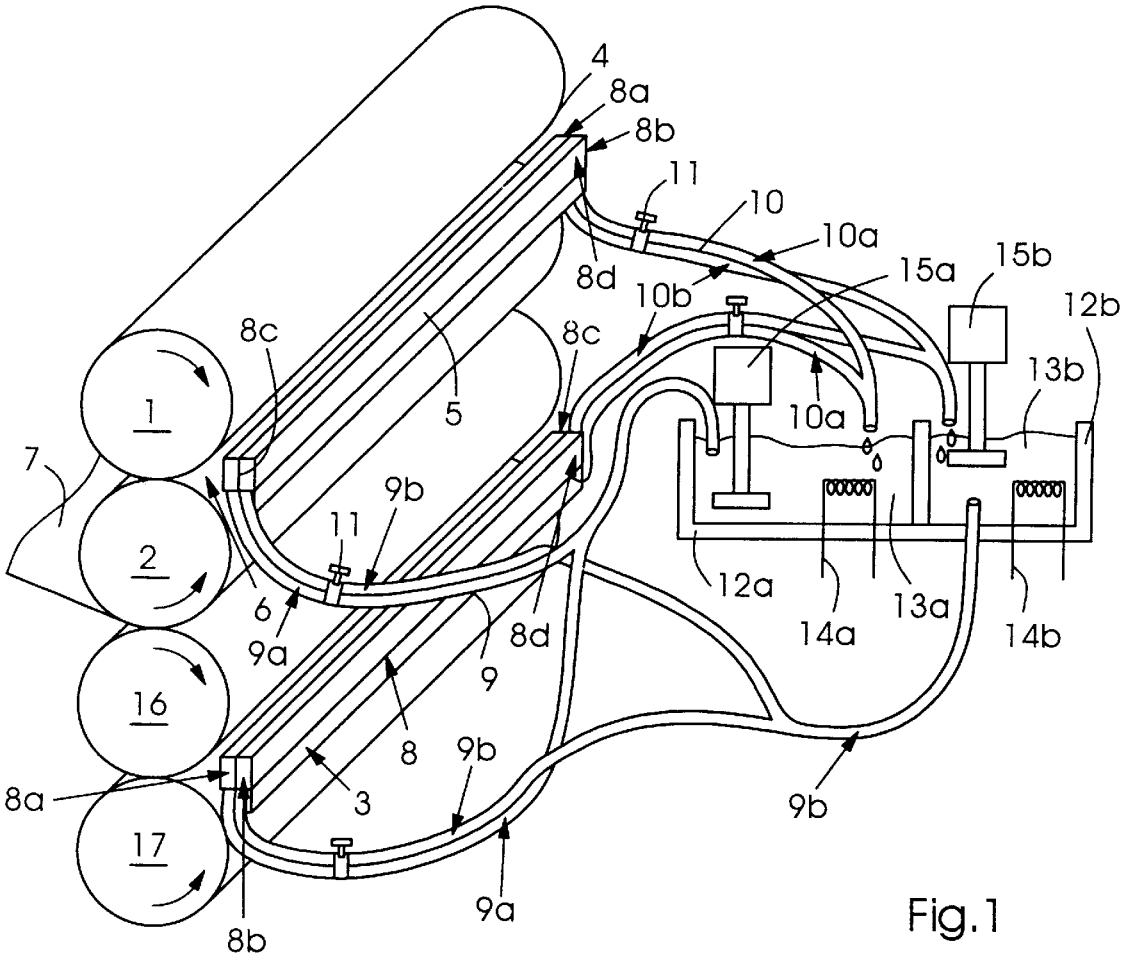
FIG. 1 shows an exemplary nip guard according to the present invention incorporated into a closed circulating system of two mediums.

FIG. 1 shows an upper cylindrical body 1 and lower cylindrical body 2 of a printing unit, such as in a web-offset lithographic printing press, for example a Heidelberg Harris M-3000 printing press. Between two first upper and lower printing unit cylinders 1, 2 and two second upper and lower printing unit cylinders 16, 17, a web of material 7 is printed on both sides thereof. A nip guard 3 protecting the press operator from being injured has surfaces indicated by 4 and 5. The nip guard 3 is connected, for example, to a pipe system 8 having a supply portion 9 as well as a recirculation portion 10, both of which are connected, for example, to a reservoir 12.

The pipe system 8 includes, for example, a first pipe portion 8*a* and a second pipe portion 8*b* separated by an insulation layer 8*c*. For example, first pipe portion 8*a* could be arranged facing towards the printing unit cylinders 1, 2 or 16, 17 while second pipe portion 8*b* could be arranged facing away from the cylinders 1, 2 or 16, 17. The supply portion 9 includes, for example, a first supply portion 9*a* connected to the first pipe portion 8*a* and a second supply portion 9*b* connected to the second pipe portion 8*b*. Similarly, the recirculation portion 10 may include, for example, a first recirculation portion 10*a* connected to the first pipe portion 8*a* and a second recirculation portion 10*b* connected to the second pipe portion 8*b*. The first pipe portion 8*a* could then, for example, be heated above the ambient air temperature by, for example, passing a heated liquid through the first supply portion 9*a* to the first pipe portion 8*a*. The second pipe portion 8*b* could be cooled below ambient air temperature by, for example, passing a cooling liquid through the second pipe portion 8*b* via the second supply portion 9*b*, the heated and cooled sides of the piping thereby preventing condensation from forming on the nip guard 3 facing the cylinders 1, 2 or 16, 17. A collection means 8*d* for collecting condensation on the cooled surface of the nip guard 3, such as a condensation collector pan 8*d* including a drain system feeding into a sealed container, prevents condensation from dripping into operational portions of the printing press or onto the web 7.

Within the reservoir 12, which may include, for example a first portion 12*a* separated from a second portion 12*b*, a first medium 13*a* can be kept in portion 12*a* at a constant temperature level and a second medium 13*b* can be kept in portion 12*b* at a constant temperature level, for example hot water being the first medium 13*a* and cold water being the second medium 13*b*. The mediums 13*a* and 13*b* within the respective reservoir portion 12*a*, 12*b* —such as water, oil, air or a mixture of other components —can each be stirred by a pumping device 15, thereby generating a uniform temperature distribution in each medium 13*a* and 13*b* within the respective reservoir portions 12*a*, 12*b*. In the event that the temperature level of either medium 13*a*, 13*b* being recirculated through the reservoir 12 via the recirculation portion 10 of the pipe system 8 has changed significantly, for example, monitored via a temperature sensor, the temperature of each medium 13*a*, 13*b* can be individually controlled, for example, via a conventional heat exchanger 14 assigned to each portion of the reservoir 12. The pipe system 8 can also include flow control devices 11*a*, 11*b* to adjust the flow of, for example, mediums 13*a*, 13*b* to the component 3.

In the exemplary embodiment shown in FIG. 1, the component which controls condensation in the area of the printing unit cylinders 1, 2 and 16, 17 is a nip guard 3 having a hollow interior. Using a closed loop of similar configuration, however, other components, such as shields, crossbars, frames, etc. of a printing unit can be integrated to prevent condensation drops being formed thereon which spoil the print quality.

FIG. 2 illustrates an exemplary condensation prevention guard 30 according to the present invention. The exemplary condensation prevention guard 30 shown in FIG. 2 includes, for example, upper guard plate 31 and lower guard plate 32. Plates 31 and 32 are, for example, connected to a frame of a print unit. By placing upper guard plate 31 in the region near printing unit cylinders 1, 2 (or, for example, near printing unit cylinders 16, 17), and, for example, adapting the upper guard plate 31 to conform to surface portions of the printing unit cylinders 1, 2 or 16, 17, the upper guard plate 31 reduces the volume of moist air between the guard plate 31 and the surface portions of the cylinders 1, 2 from which water can be extracted in the form of condensation onto the lithographic fluids on the printing unit cylinders 1, 2. Further, the upper guard plate 31 can be configured, for example as shown in FIG. 2, to have two or more rounded portions connected together to collect condensation on a surface of the upper guard plate 31, e.g., between the connected rounded portions. Alternatively, for example, the surface of upper guard plate 31 could be flat with a concave profile to collect condensation.

Also as shown in FIG. 2, a lower guard plate 32 can be used in conjunction with the upper guard plate 31, also having a shape adapted to conform to the surfaces of the printing unit cylinders 1, 2 or 16, 17 to further reduce the available moist air between the guard plate 32 and the surface portions of the cylinders 1, 2 from which water can condense onto the printing unit cylinders 1, 2. In one embodiment of the present invention, the condensation prevention guard 30 may be a passive device, e.g., merely placed in the region of the printing unit cylinders 1, 2 or 16, 17, and thus reducing the volume of moist air which can condense onto, for example, the printing unit cylinders 1, 2 or 16, 17. For example, guard plates 31 and 32 can be placed within one inch or even ¼ inch from the surface portions of the cylinders 1, 2 or 16, 17 to effectively reduce the volume of moist air available to form condensation on the cylinders.

In another exemplary embodiment of the condensation prevention guard 30 according to the present invention illustrated in FIG. 3, a surface 31*a* of upper guard plate 31 facing towards the printing unit cylinders 1, 2 is heated above the ambient air temperature to prevent condensation from forming on the upper guard plate 31 in the region of the printing unit cylinders 1, 2 while a surface 31*b* of the upper guard plate 31 facing away from the printing unit cylinders 1, 2 is cooled below the dewpoint of the ambient atmosphere in a manner which will not cause process defects. An exemplary arrangement for providing the heating and cooling of condensation prevention guard 30 is illustrated in FIG. 3.

For example, upper guard plate 31 may include outside layer 40 of sheet metal or other suitable material separated by an insulation layer 41 such as a polystyrene or polyethylene insulation or foam or a fiberglass material. Disposed below surface 31*b* is an opening 40*b* and disposed above surface 31*a* is an opening 40*a*, openings 40*a* and 40*b* being separated by the insulation layer 41. To heat the surface 31*a*, hot water can be pumped through the opening 40*a*, thereby heating the surface 31*a* via, for example, a pipe portion 8*a*, supply portion 9*a* and recirculation portion 10*a* including a reservoir 12*a* and a pumping device 15*a* as described for example, with respect to FIG. 1. To cool the surface 31*b*, cool water similarly can be pumped through the opening 40*b*, thereby cooling the surface 31*b* via, for example, pipe portions 8*b*, supply portion 9*b* and recirculation portion 10*b* including a reservoir 12*b* and a pumping device 15*b*. As shown in FIG. 3, the surface 31*b* can be configured to collect condensation which forms on the cool surface 31*b*.

The lower guard plate 32 can be similarly constructed to heat the side of the lower guard plate 32 facing towards the cylinder surfaces 1, 2 while cooling the side of the lower guard plate 32 facing away from the cylinder surfaces 1, 2, provided that means are disposed below the lower guard plate 32 to collect condensation, such as a condensation collection pan 8*d* with a drain system, such as a gravity-fed drain to a sealed container. Alternatively, as illustrated in FIG. 3, lower guard plate 32 can include outside layers 50 of sheet metal or other suitable material having a single opening 50*a* therebetween through which hot water can be pumped through to heat the lower guard plate 32 so that the temperature of the lower guard plate 32 can be maintained above the ambient dew point, thereby preventing condensation.

While the condensation prevention guard 30 according to the present invention has been described with regard to preventing condensation on printing unit cylinders 1, 2 and 16, 17, it is understood that the condensation prevention guard 30, including, for example, upper guard plate 31 and/or lower guard plate 32, can be applied to many different systems having condensation problems including, for example, rolls of a dampening system of a lithographic printing press.

What is claimed is:

1. A condensation prevention guard, comprising:

a first guard member including an upper surface and a roll-facing surface, the roll-facing surface being disposed opposite the upper surface and facing a first surface portion of a roll, wherein the first guard member reduces a volume of air between the roll-facing surface and the first surface portion of the roll, thereby reducing an amount of condensation onto the roll, wherein the roll-facing surface includes a rounded roll-conforming portion conforming to the first surface portion of the roll.

2. The condensation prevention guard according to claim 1, wherein the roll-facing surface is disposed within one inch of the first surface portion of the roll.

3. The condensation prevention guard according to claim 1, wherein the roll-facing surface is disposed approximately one-quarter inch from the first surface portion of the roll.

4. The condensation prevention guard according to claim 1, wherein the roll includes one of a cylinder of a printing press and a printing article mounted on a cylinder of a printing press.

5. The condensation prevention guard according to claim 4, wherein the printing article includes one of a printing plate, a printing blanket and a print sleeve.

6. The condensation prevention guard according to claim 1, further comprising a second guard member disposed below the first guard member, the second guard member including a roll-facing surface, the roll-facing surface being disposed adjacent to a second surface portion of the roll, wherein the second guard member reduces a volume of air between the roll-facing surface of the second guard member and the second surface portion of the roll, thereby reducing an amount of condensation onto the roll.

7. A condensation prevention guard, comprising:

an upper guard member including a condensation collection portion, a roll-facing portion and an insulation layer disposed between the condensation collection portion and the roll-facing portion, the roll-facing portion being disposed opposite the condensation collection portion and facing a first surface portion of a roll;

wherein the condensation collection portion includes a condensation collection surface and a first opening disposed through the condensation collection portion, and wherein the roll-facing portion includes a roll-facing surface and a second opening disposed through the roll-facing portion, a first medium being provided through the first opening to cool the condensation collection portion and a second medium being provided through the second opening to heat the roll-facing portion; and wherein the upper guard member reduces a volume of air between the roll-facing surface and the, first surface portion of the roll, thereby reducing an amount of condensation onto the roll, and in an operative state increases an ambient air temperature in an area adjacent to the first surface portion of the roll and causes condensation to collect on the condensation collection surface.

8. The condensation prevention guard according to claim 7, further comprising:

a first supply system connected to the first opening, the first supply system providing the first medium through the first opening to reduce a temperature of the condensation collection portion; and a second supply system connected to second opening, the second supply system providing the second medium through the second opening to increase a temperature of the roll-facing portion.

9. The condensation prevention guard according to claim 8, wherein the first supply system includes a first supply portion connected to the first opening to provide the first medium to the first opening, a first reservoir and pumping system connected to the first supply portion to provide the first medium to the first supply portion, and a first recirculation system connected to the first opening to recirculate the first medium from the first opening to the first reservoir and pumping system, and wherein the second supply system includes a second supply portion connected to the second opening to provide the second medium to the second opening, a second reservoir and pumping system connected to the second supply portion to provide the second medium to the second supply portion, and a second recirculation system connected to the second opening to recirculate the second medium from the second opening to the second reservoir and pumping system.

10. The condensation prevention guard according to claim 9, wherein the first supply system further includes a first heat exchanger assigned to the first reservoir and pumping system and the second supply system further includes a second heat exchanger assigned to the second reservoir and pumping system.

11. The condensation prevention guard according to claim 7, further comprising a lower guard member disposed below the upper guard member, the lower guard member including a roll-facing portion, the roll-facing portion including a roll-facing surface being disposed adjacent to a second surface portion of the roll and a third opening being disposed through the roll-facing portion, wherein the lower guard member reduces a volume of air between the roll-facing surface of the lower guard member and the second surface portion of the roll, thereby reducing an amount of condensation onto the roll and a third medium being provided through the third opening head the roll-facing portion of the lower guard member thereby increasing an ambient air temperature in an area adjacent to the second surface portion of the roll.

12. The condensation prevention guard according to claim 11, further comprising a third supply system connected to the third opening, the third supply system providing the third medium through the third opening to increase a temperature of the roll-facing portion of the lower guard member.

13. The condensation prevention guard according to claim 7, wherein the first and mediums include one of water, oil, air and/or an antifreeze compound.

14. The condensation prevention guard according to claim 7, wherein the roll-facing surface includes a roll-conforming portion conforming to the first surface portion of the roll.

15. The condensation prevention guard according to claim 7, wherein the roll-facing surface is disposed within one inch of the first surface portion of the roll.

16. The condensation prevention guard according to claim 15, wherein the roll-facing surface is disposed approximately one-quarter inch from the first surface portion of the roll.

17. The condensation prevention guard according to claim 7, wherein the condensation collection surface includes a first rounded portion connected to a second rounded portion, a collection area being formed therebetween to collect condensation formed on the condensation collection surface.

18. The condensation prevention guard according to claim 6, further comprising a condensation collection system connected to at least one of the first guard member and the second guard member.

19. A condensation prevention guard, comprising:

a first guard member including an upper surface and a roll-facing surface, the roll-facing surface being disposed opposite the upper surface and facing a first surface portion of a roll, wherein the first guard member reduces a volume of air between the roll-facing surface and the first surface portion of the roll, thereby reducing an amount of condensation onto the roll, wherein the upper surface forms a condensation collection surface and includes a first rounded portion connected to a second rounded portion, a collection area being formed therebetween to collect condensation formed on the condensation collection surface.

* * * * *